US010434632B2

(12) United States Patent
Chang

(10) Patent No.: US 10,434,632 B2
(45) Date of Patent: Oct. 8, 2019

(54) TOOL CONNECTOR

(71) Applicant: Yeh-Ching Chang, Taichung (TW)

(72) Inventor: Yeh-Ching Chang, Taichung (TW)

( * ) Notice: Subject to any disclaimer, the term of this patent is extended or adjusted under 35 U.S.C. 154(b) by 70 days.

(21) Appl. No.: 15/846,829

(22) Filed: Dec. 19, 2017

(65) Prior Publication Data

US 2019/0184529 A1 Jun. 20, 2019

(51) Int. Cl.
*B25B 23/00* (2006.01)
*B25B 21/00* (2006.01)

(52) U.S. Cl.
CPC ..... *B25B 23/0035* (2013.01); *B25B 23/0021* (2013.01); *B25B 21/00* (2013.01)

(58) Field of Classification Search
CPC .. B25B 23/0035; B25B 23/0021; B25B 21/00
USPC ..... 81/177.85, 451, 438
See application file for complete search history.

(56) References Cited

U.S. PATENT DOCUMENTS 1,138,465 A * 5/1915 Fegley et al. ..... B23B 31/113 279/82
1,209,572 A * 12/1916 Fegley ..... B23B 31/1071 279/82
7,114,728 B2 * 10/2006 Chen ..... B23B 31/107 279/24
8,262,097 B2 * 9/2012 Lai ..... B23B 31/107 279/155
8,308,168 B2 * 11/2012 Nash ..... B25B 23/0035 279/155
2012/0126497 A1 * 5/2012 Lin ..... B25B 23/0035 279/155

FOREIGN PATENT DOCUMENTS

TW I241231 B 10/2005
TW I365128 B 6/2012

* cited by examiner

*Primary Examiner* — Hadi Shakeri
(74) *Attorney, Agent, or Firm* — Muncy, Geissler, Olds & Lowe, P.C.

(57) ABSTRACT

A tool connector is provided, including: a shaft, including a connection end configured to be connected to a driving tool; a slidable sleeve, slidably disposed around the shaft; a tubular member, disposed around the shaft, including an inner hole, an insertion opening communicated with the inner hole and a slanted slot communicated with the inner hole, the slanted slot extending inwardly toward the insertion opening; a locking mechanism, including an elastic mechanism and a locking mechanism, the elastic mechanism abutted between the slidable sleeve and the locking mechanism, the elastic mechanism normally urging the locking mechanism in a direction toward the slanted slot, the locking mechanism including a driven portion comovable with the slidable sleeve, and a locking portion received within the slanted slot and radially projectable into the inner hole.

8 Claims, 9 Drawing Sheets

TOOL CONNECTOR

BACKGROUND OF THE INVENTION

Field of the Invention

The present invention relates to a connector, and particularly to a tool connector.

Description of the Prior Art

A conventional connector for a tool bit (such as screwdriver bit) includes a rod body, an outer sleeve and a connecting rod. The connecting rod and the rod body are assembled with each other, the connecting rod is for assembling with a driving device, and the rod body is for connection with a tool bit. The outer sleeve is slidably assembled with the rod body and slidable between a locking position and a release position. Through the outer sleeve pressing a blocking member to block into an engagement recess of the tool bit, the tool bit is lockably held. When the outer sleeve moves, relative to the rod body, to the release position, the blocking member can move radially outward into a space of the outer sleeve so as to release the engagement of the tool bit with the engagement recess, so that the tool bit can be detached. TW I241231 and TW I365128 disclose the kind of aforementioned tool.

However, in the conventional connector, the outer sleeve has to be manufactured to include function of pressing the blocking member and provide release space for the blocking member. As a result, the inner wall of the outer sleeve has must include a protrusive-recessed structure, so the structure is complicated, it is hard to process the inner wall of the outer sleeve and it is not precise, so that the tool bit cannot be stably locked and is easy to disengage.

The present invention is, therefore, arisen to obviate or at least mitigate the above mentioned disadvantages.

SUMMARY OF THE INVENTION

An object of the present invention is to provide a tool connector, with which it is able to quickly lock or unlock an insert member.

To achieve the above and other objects, a tool connector is provided, including: a shaft, including a connection end configured to be connected to a driving tool; a slidable sleeve, slidably disposed around the shaft; a tubular member, disposed around the shaft, including an inner hole, an insertion opening communicated with the inner hole and a slanted slot communicated with the inner hole, the slanted slot extending inwardly toward the insertion opening; a locking mechanism, including an elastic mechanism and a locking mechanism, the elastic mechanism abutted between the slidable sleeve and the locking mechanism, the elastic mechanism normally urging the locking mechanism in a direction toward the slanted slot, the locking mechanism including a driven portion comovable with the slidable sleeve, and a locking portion received within the slanted slot and radially projectable into the inner hole.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
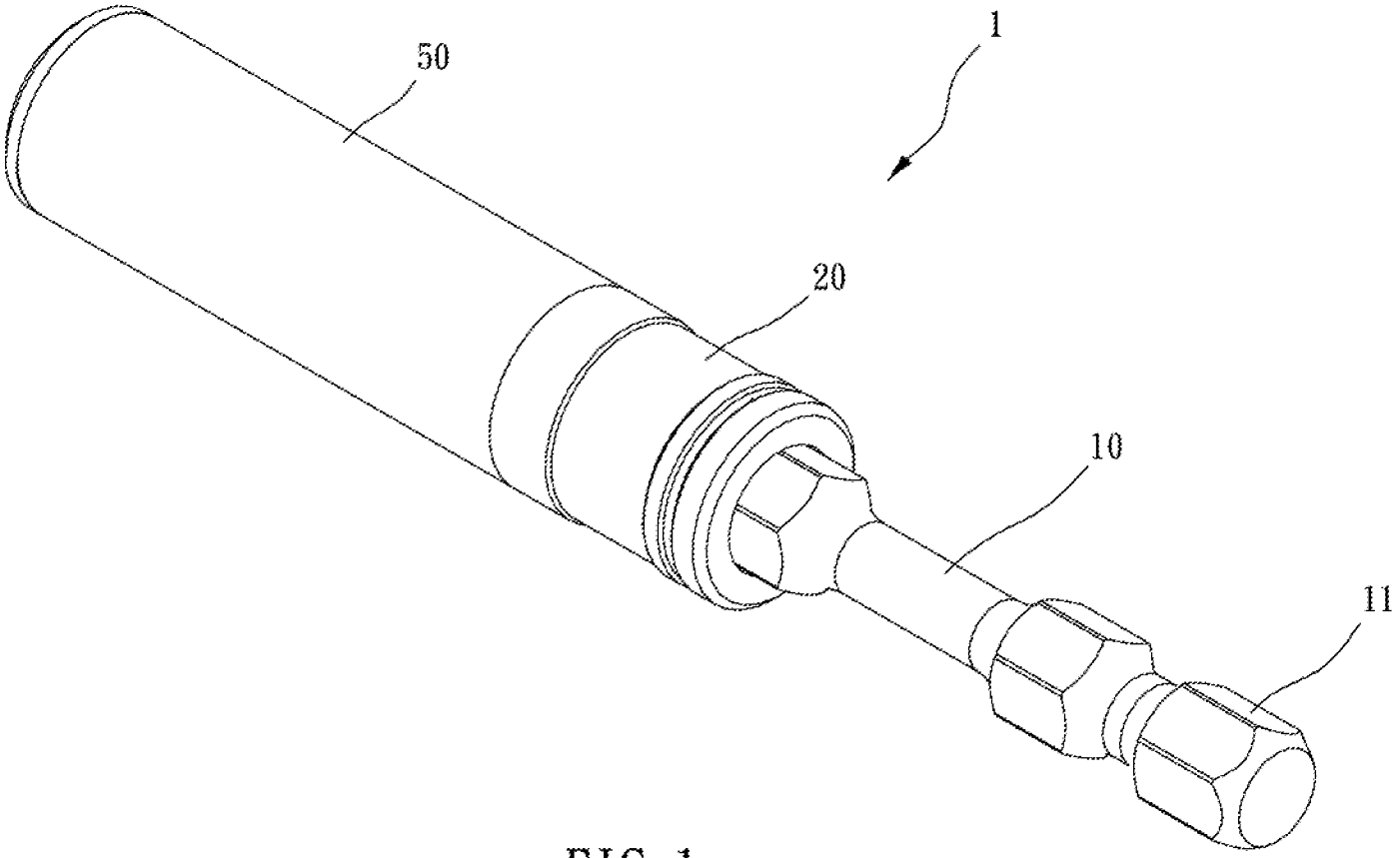
FIG. 1 is a perspective view according to a preferred embodiment of the present invention.
Figure 2:
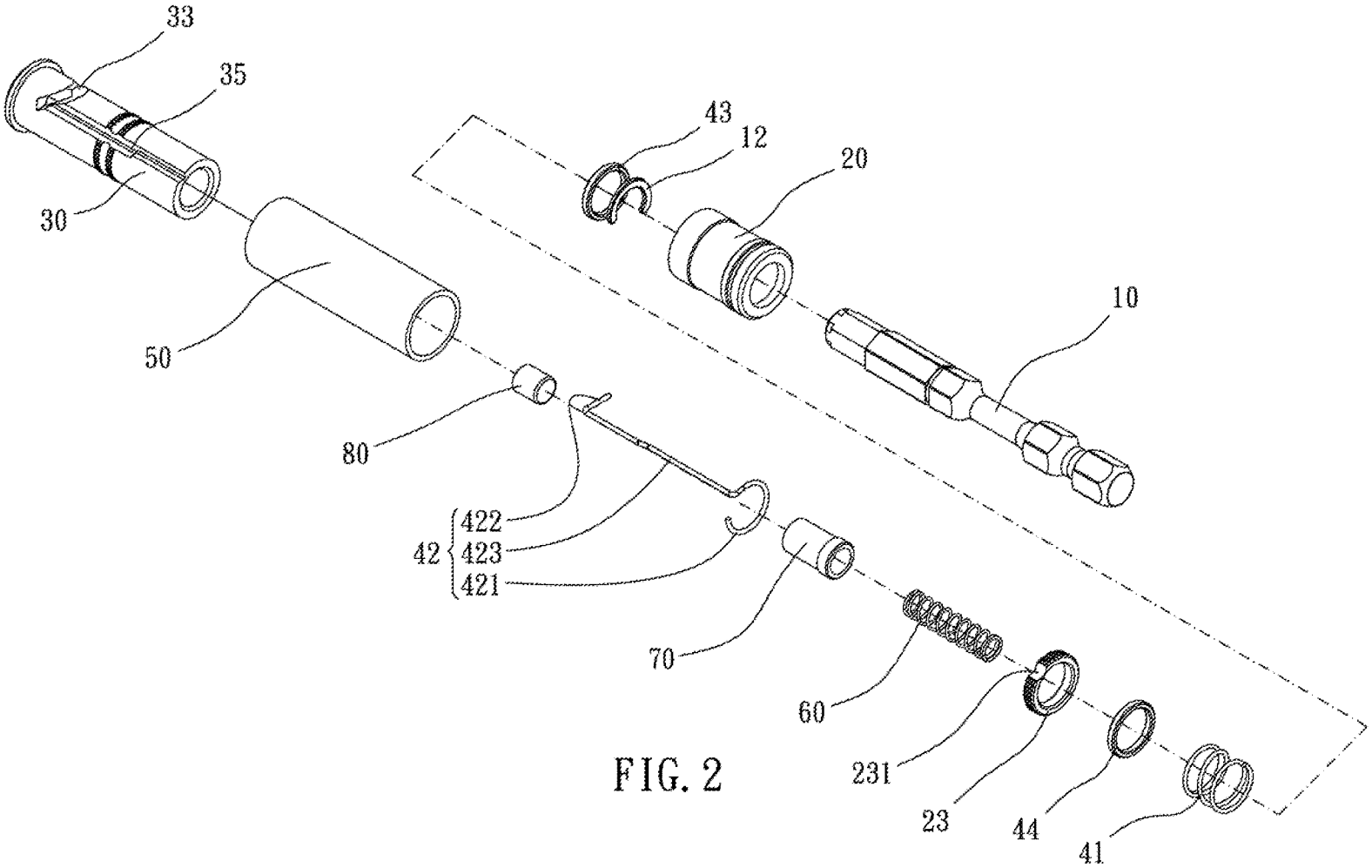
FIG. 2 is a breakdown drawing of a preferred embodiment of the present invention.
Figure 3:
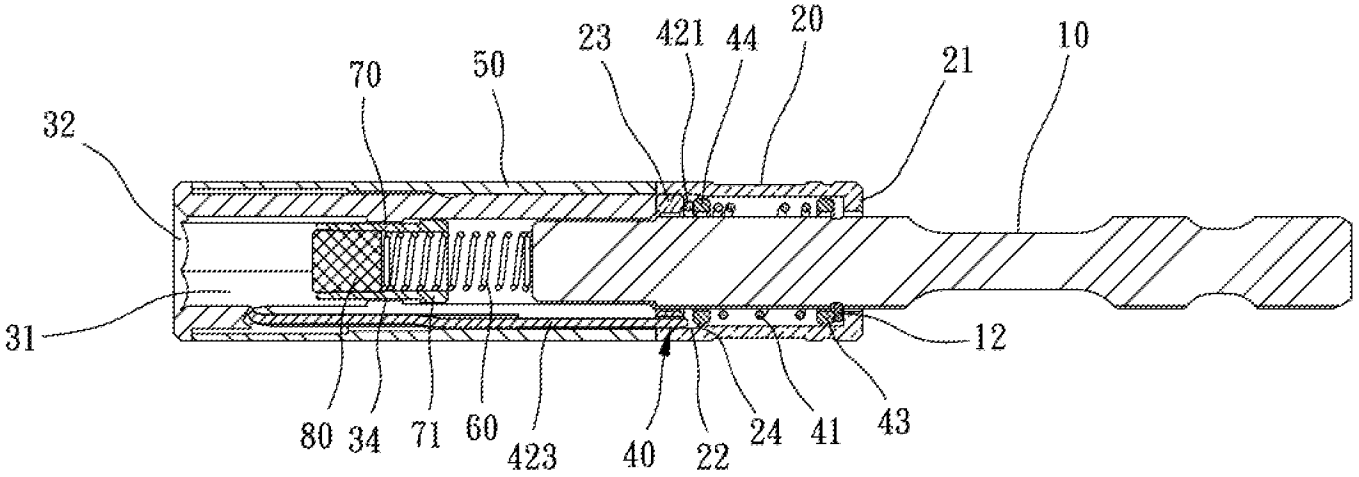
FIG. 3 is a cross-sectional view of a preferred embodiment of the present invention.
Figure 4:
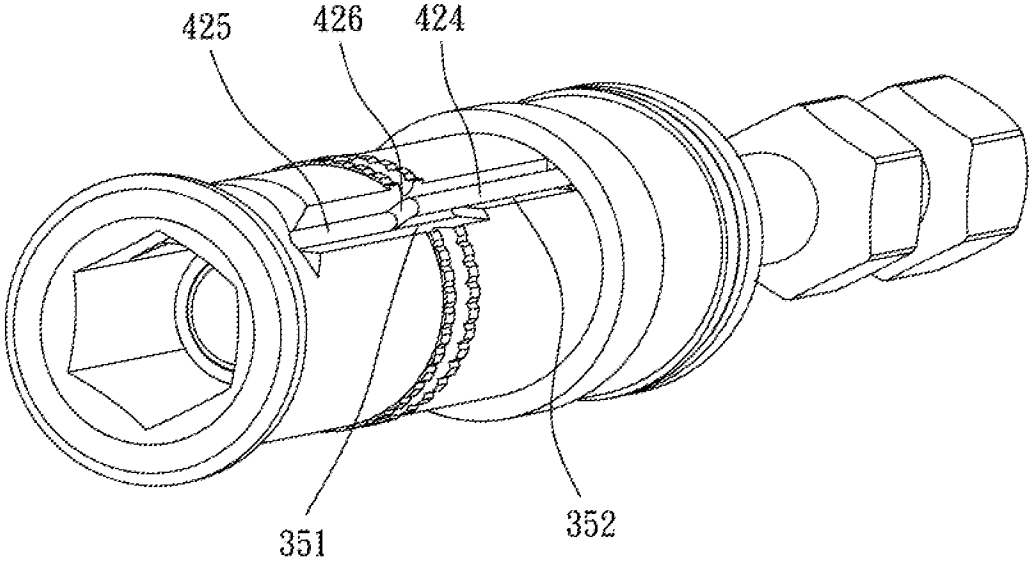
FIG. 4 is a view showing inner parts according to a preferred embodiment of the present invention.

FIGS. 1-6 show a tool connector according to a preferred embodiment of the present invention. The tool connector 1 includes a shaft 10, a slidable sleeve 20, a tubular member 30 and a locking mechanism 40.

Figure 8:
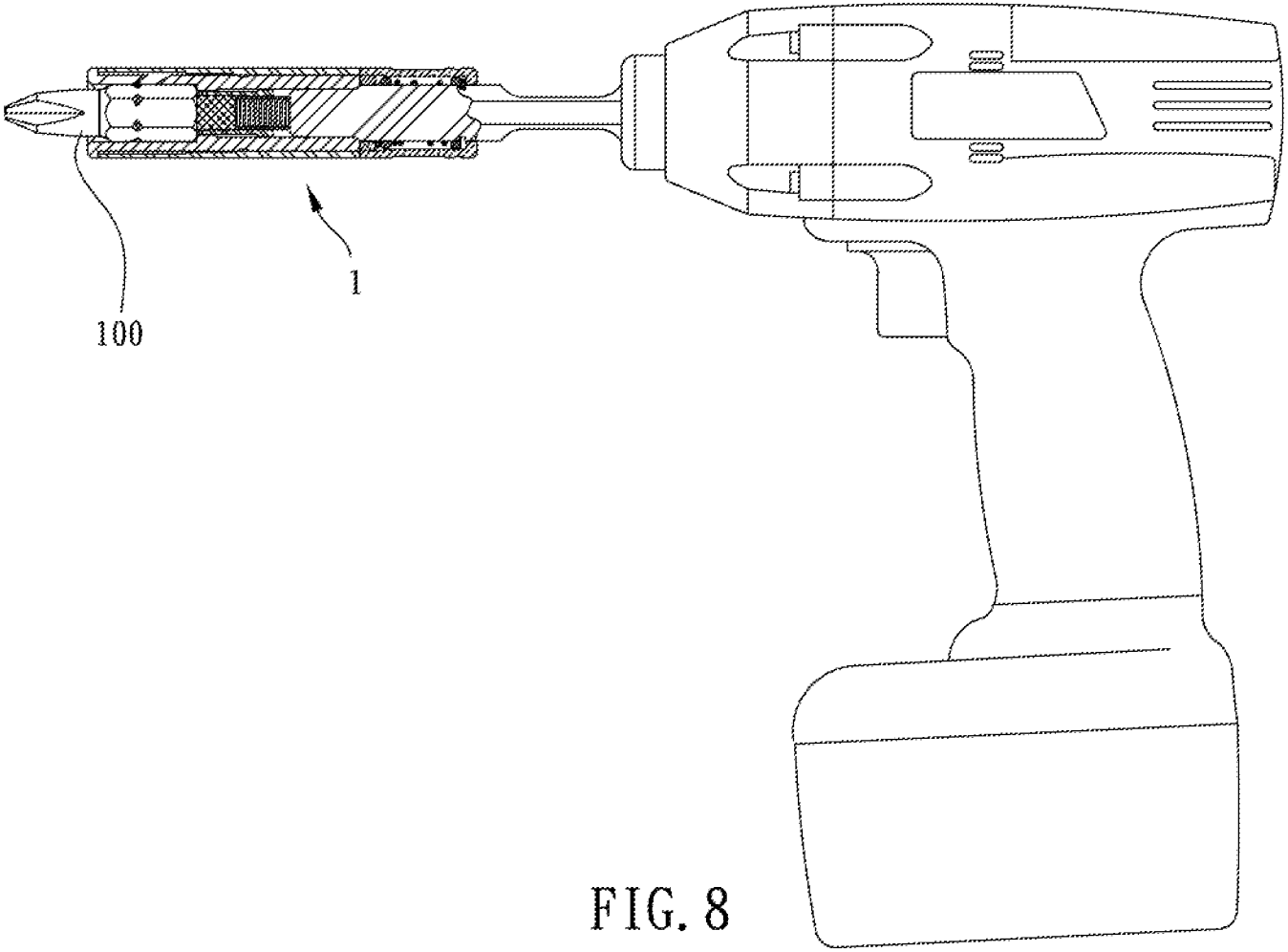
Figure 9:
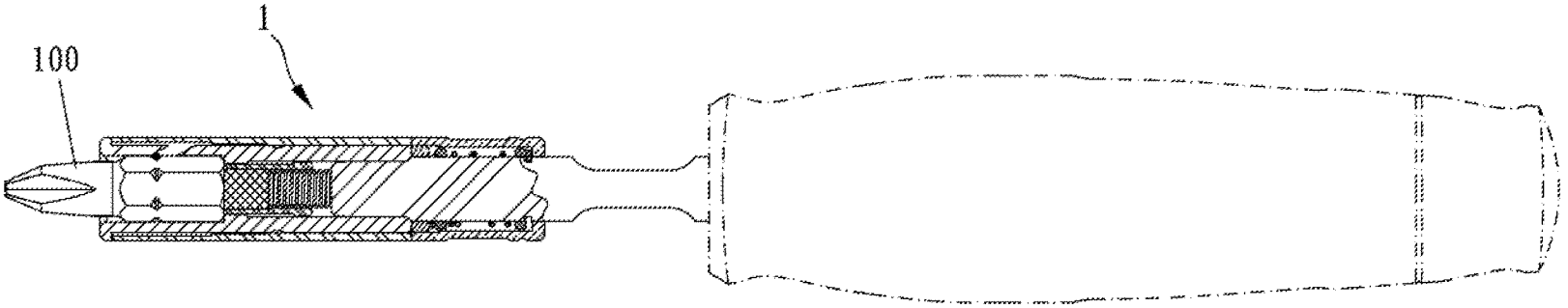

The shaft 10 includes a connection end 11 configured to be connected to a driving tool. The slidable sleeve 20 is slidably disposed around the shaft 10. The tubular member 30 is disposed around the shaft 10, the tubular member 30 includes an inner hole 31, an insertion opening 32 communicated with the inner hole 31 and a slanted slot 33 communicated with the inner hole 31, and the slanted slot 33 extends inwardly toward the insertion opening. The locking mechanism 40 includes an elastic mechanism 41 and a locking mechanism 42, the elastic mechanism 41 abutted between the slidable sleeve 20 and the locking mechanism 42, and the elastic mechanism 41 normally urges the locking mechanism 42 in a direction toward the slanted slot 33. The locking mechanism 42 includes a driven portion 42 lcomovable with the slidable sleeve 20, and a locking portion 422 received within the slanted slot 33 and radially projectable into the inner hole 31. Whereby, the locking mechanism 40 can sufficiently lock or unlock an insert member 100 (such as tool bit, extension rod or the like), thus being able to quickly replace the insert member 100, having a simple structure and being easy to use. The slanted groove may be open with a V-shaped opening on the outer face of the tubular section, or may be an enclosed slanted groove on the outer face of the tubular section. The connection end 11 is configured for connection with a powered too (such as a pneumatic tool shown in FIG. 6, or an electrical tool shown in FIG. 8), extension rod (such as elongate tool with a handle and a socket for receiving a screwdriver bit), wrench socket or the like. The connection end may be integrally formed with a handle (as shown in FIG. 9).

The slidable sleeve 20 further includes an inner flange 21, and the shaft 10 further includes a radial flange 12 located between the connection end 11 and the elastic mechanism 41 and blockable with the inner flange 21. The radial flange 12 may be a C-ring, or integrally protrudes radially from the shaft 10.

The slidable sleeve 20 further includes a slot 22 on an inner side thereof, and the driven portion 421 is axially movably disposed within the slot 22. An inner ring member 23 is disposed in the slidable sleeve 20 and located between the driven portion 421 and the tubular member 30, and the driven portion 421 is blockable with the inner ring member 23. Specifically, the slidable sleeve 20 has a large-diameter hole at one end and a shoulder portion 24 at a bottom of the large-diameter hole, and the inner ring member 23 is annularly assembled in the large-diameter hole and forms the slot 22 with the shoulder portion 24.

Preferably, the locking mechanism 40 further includes a first ring member 43 located between the elastic mechanism 41 and the inner flange 21, and a second ring member 44 between the elastic mechanism 41 and the inner ring member 23. The elastic mechanism 41 may be a coil spring, and the first ring member 43 and the second ring member 44 are abutted against two ends of the coil spring, thus evening force from the coil spring. The driven portion 421 is C-Shaped and disposed around the shaft 10, and the driven portion 421 is slidable between the second ring member 44 and the inner ring member 23. The locking mechanism 42 further includes a body portion 423 connected to the driven portion 421 and the locking portion 422, the inner ring member 23 includes a notch 231, the notch 231 and the slidable sleeve 20 define a passageway, and the body portion 423 extends through the passageway. The tubular member 30 further includes an elongate stepped groove 35 communicated with the slanted slot 33 and the passageway between, for guiding the locking mechanism 42. The elongate stepped groove 35 includes a deep groove 351 communicated with the slanted slot 33 and a shallow groove 352 communicated with the passageway. The body portion 423 includes a first section 424, a second section 425 and a transitional section 426 connected to the first section 424 and the second section 425. The first section 424 is received within the shallow groove 352, and the second section 425 is received within the deep groove 351, for limiting movement of the locking mechanism 42 and enhancing restricting engagement of the locking portion 422.

Preferably, the tool connector 1 further includes an outer sleeve 50 disposed around the tubular member 30 and at least around the slanted slot 33 and the locking portion 422, for limitation and stabilization of the locking portion 422 during operation. The tool connector 1 further includes an elastic member 60 which is received within the tubular member 30 and abutting against the shaft 10 and a push member 70 which is abutted against the elastic member 60. The tubular member 30 further includes an inner radial flange 34 thereinside, and the push member 70 includes an outer radial flange 71 blockable with the inner radial flange 34, for limiting movement of the insert member 100 within a suitable distance. Preferably, the tool connector 1 further includes a magnetic member 80 attached to the push member 70, for avoiding detachment of the insert member 100.

Figure 5:
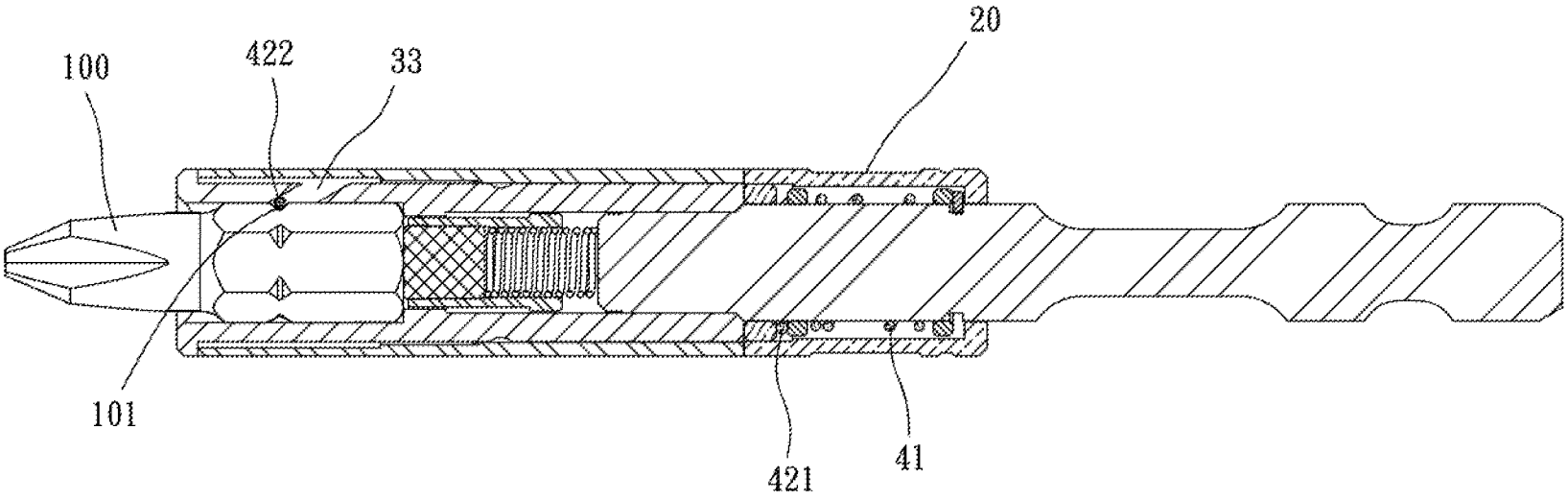
FIGS. 5 and 6 are drawings showing a tool connector in use according to a preferred embodiment of the present invention.
Figure 6:
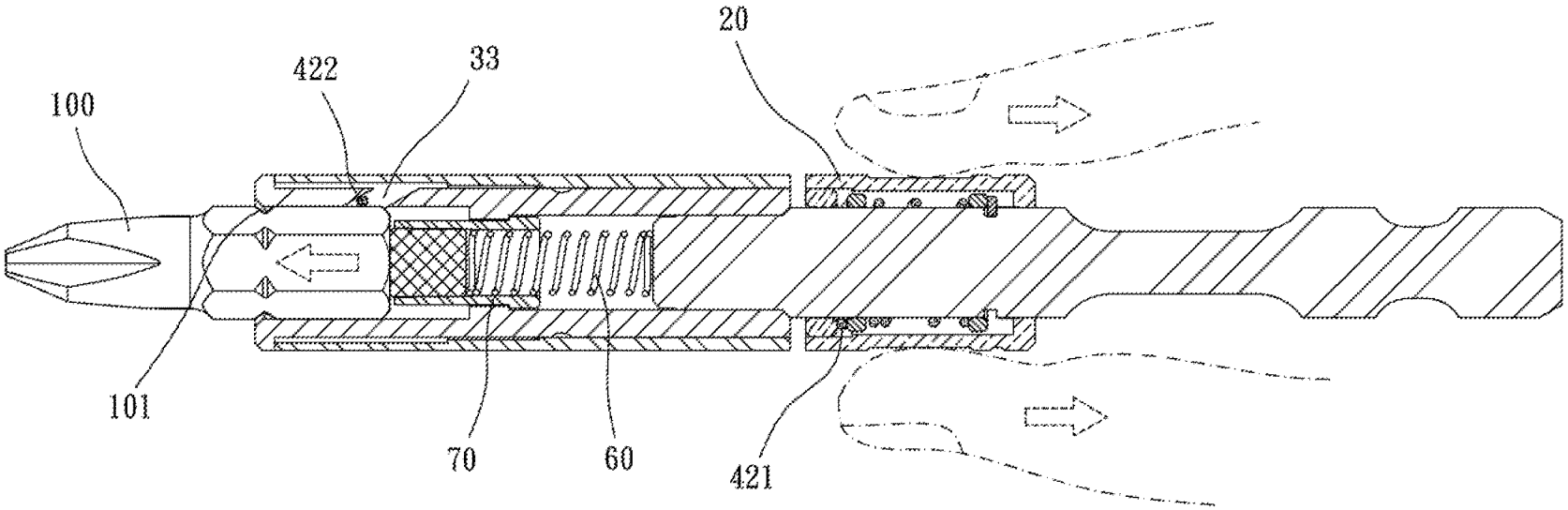
Figure 7:
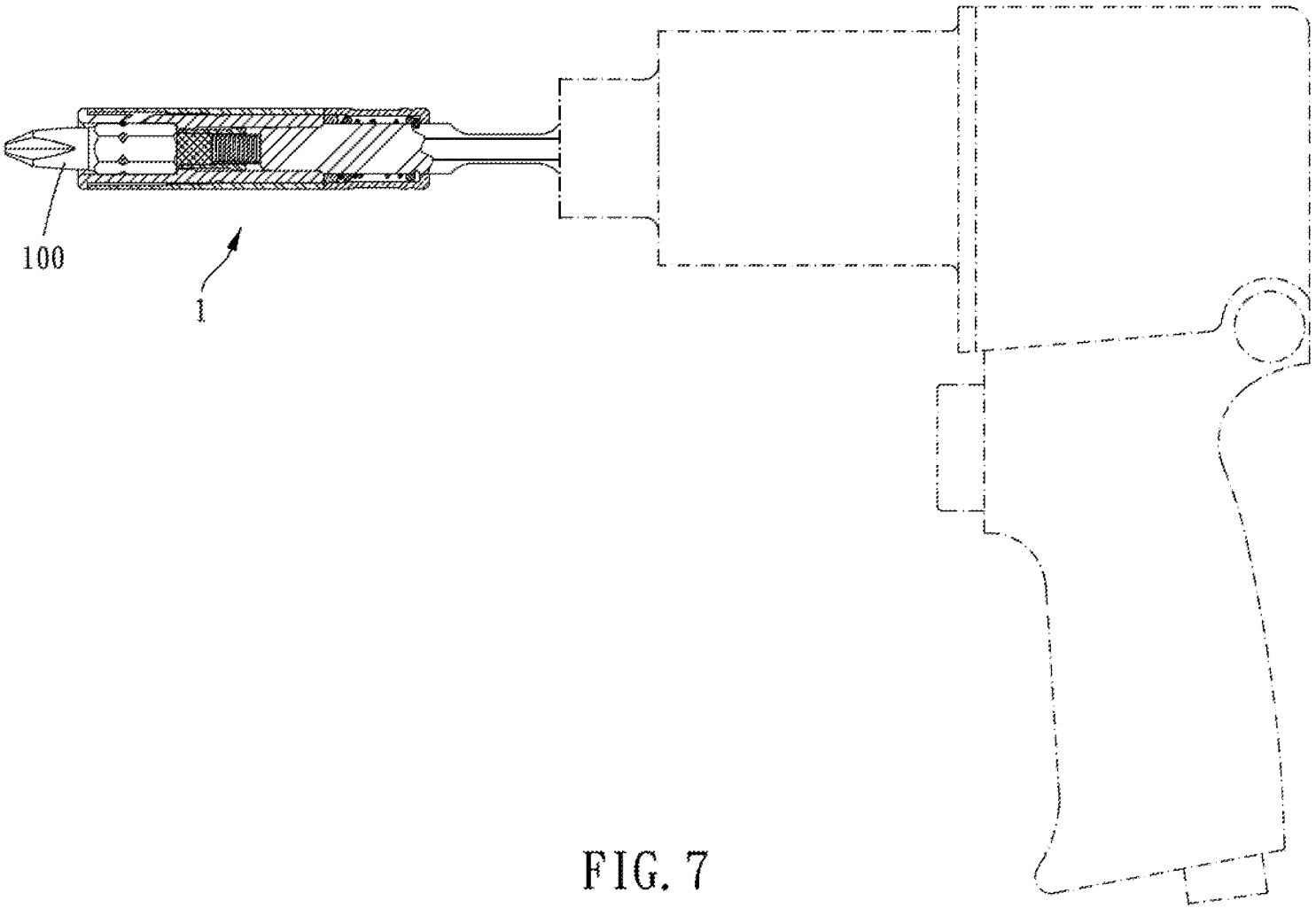
FIGS. 7 to 9 are drawings showing three applications of tool connector according to different preferred embodiments of the present invention.

In operation, when the insert member 100 is inserted into the insertion opening 32, the insert member presses the locking portion 422 to move backward, the slot 22 permits the driven portion 421 to slightly move backward without moving the slidable sleeve 20 backward (labor-saving). When an engagement recess 101 of the insert member 100 is aligned radially to the slanted slot, the elastic mechanism 41 pushes the driven portion 421 forward so that the locking portion 422 locks the engagement recess 101 normally. As a result, the insert member 100 can be locked automatically and is not easy to disengage (as shown in FIG. 5); to detach the insert member 100, the slidable sleeve 20 is moved backward axially to drive the driven portion 421 and the locking portion 422 disengages from the engagement recess 101 along the slanted slot 33, and the elastic member 60 pushes the push member 70 to move forward and the insert member 100 can be jetted out automatically (as shown in FIG. 6). As a result, the user can replace the insert member by one single hand, and it is convenient, time-saving, and helpful to work.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool connector, including:

a shaft, including a connection end configured to be connected to a driving tool;

a slidable sleeve, slidably disposed around the shaft;

a tubular member, disposed around the shaft, including an inner hole, an insertion opening communicated with the inner hole and a slanted slot communicated with the inner hole, the slanted slot extending inwardly toward the insertion opening;

a locking mechanism, including an elastic mechanism and a locking mechanism, the elastic mechanism abutted between the slidable sleeve and the locking mechanism, the elastic mechanism normally urging the locking mechanism in a direction toward the slanted slot, the locking mechanism including a driven portion comovable with the slidable sleeve, and a locking portion received within the slanted slot and radially projectable into the inner hole;

wherein an inner ring member is disposed in the slidable sleeve and located between the driven portion and the tubular member, and the driven portion is blockable with the inner ring member;

wherein the inner ring member includes a notch, the notch and the slidable sleeve define a passageway, the locking mechanism further includes a body portion connected to the driven portion and the locking portion, and the body portion extends through the passageway.

2. The tool connector of claim 1, wherein the slidable sleeve further includes an inner flange, and the shaft further includes a radial flange located between the connection end and the elastic mechanism and blockable with the inner flange.

3. The tool connector of claim 2, wherein the locking mechanism further includes a first ring member located between the elastic mechanism and the inner flange.

4. The tool connector of claim 1, wherein the slidable sleeve further includes a slot on an inner side thereof, and the driven portion is axially movably disposed within the slot.

5. The tool connector of claim 1, wherein the tubular member further includes an elongate stepped groove communicated with and between the slanted slot and the passageway, the elongate stepped groove includes a deep groove communicated with the slanted slot and a shallow groove communicated with the passageway, the body portion includes a first section, a second section and a transitional section connected to the first section and the second section, the first section is received within the shallow groove, and the second section is received within the deep groove.

6. The tool connector of claim 1, wherein the locking mechanism further includes a second ring member between the elastic mechanism and the inner ring member.

7. The tool connector of claim 1, further including an outer sleeve which is disposed around the tubular member and at least around the slanted slot and the locking portion.

8. The tool connector of claim 1, further including an elastic member which is received within the tubular member and abutted against the shaft and a push member which is abutted against the elastic member, the tubular member further includes an inner radial flange thereinside, and the push member includes an outer radial flange blockable with the inner radial flange.

* * * * *